US006206223B1

(12) United States Patent
Wicker

(10) Patent No.: US 6,206,223 B1
(45) Date of Patent: Mar. 27, 2001

(54) CAN COOLER

(76) Inventor: Raymond A. Wicker, 68 Five Finger Peaks Rd., Gillette, WY (US) 82716

( * ) Notice: Subject to any disclaimer, the term of this patent is extended or adjusted under 35 U.S.C. 154(b) by 0 days.

(21) Appl. No.: 09/458,712

(22) Filed: Dec. 13, 1999

Related U.S. Application Data

(60) Provisional application No. 60/123,870, filed on Mar. 11, 1999.

(51) Int. Cl.[7] ..... B65D 53/00

(52) U.S. Cl. ..... 220/375; 220/739; 220/754

(58) Field of Search ..... 220/737, 739, 220/375, 754

(56) References Cited

U.S. PATENT DOCUMENTS

| | | | | |
|---|---|---|---|---|
| 2,951,615 | * | 9/1960 | Crane | 220/754 |
| 3,451,536 | * | 6/1969 | O'Leary et al. | 220/754 |
| 3,995,445 | | 12/1976 | Huskins . | |
| 4,183,226 | | 1/1980 | Moore . | |
| 4,344,303 | | 8/1982 | Kelly, Jr. . | |
| 4,526,289 | * | 7/1985 | Schiemann | 220/375 |
| 4,620,426 | | 11/1986 | Pitchford et al. . | |
| 4,741,176 | | 5/1988 | Johnson et al. . | |
| 4,793,149 | | 12/1988 | Riche . | |
| 5,004,114 | * | 4/1991 | Terbrusch et al. | 220/375 |
| 5,044,512 | * | 9/1991 | Giancaspro et al. | 220/375 |
| 5,165,583 | * | 11/1992 | Kouwenbry | 220/754 |
| 5,261,554 | * | 11/1993 | Forbes | 220/739 |
| 5,325,988 | * | 7/1994 | Ekern | 220/739 |
| 5,361,604 | | 11/1994 | Pier et al. . | |
| 5,564,583 | | 10/1996 | Kelley et al. . | |
| 6,014,850 | * | 1/2000 | LeMire | 220/754 |
| 6,039,207 | * | 3/2000 | Adamek | 220/739 |

FOREIGN PATENT DOCUMENTS

| | | | | |
|---|---|---|---|---|
| 2220642 | * | 1/1990 | (GB) | 220/754 |
| 2240332 | | 7/1991 | (GB) . | |

* cited by examiner

*Primary Examiner*—Joseph M. Moy
(74) *Attorney, Agent, or Firm*—Richard C. Litman

(57) ABSTRACT

A light-weight, spill resistant, easy to use barrel-shaped can cooler receptacle having a foam main body with a mating foam lid that are snug to the can and are leashed together by a flexible hinge. The can cooler is capable of receiving, protecting from spill, and keeping chilled a single soda or beer can. The main, lower body of the can cooler has a sloped upper surface to facilitate easy insertion of a can. The lid has a similarly sloped surface so as to enable an even, flush mating with the lower body. The lid can be quickly mated with the body of the receptacle without the need for any twisting or turning of the lid. Both the main body and lid are snug against the surface of the can, and are thus retained by friction. The lid may be opened and closed with the thumb and index finger of a single hand.

7 Claims, 3 Drawing Sheets

CAN COOLER

CROSS-REFERENCE TO RELATED APPLICATION

This application claims the benefit of U.S. Provisional patent Application Ser. No. 60/123,870, filed Mar. 11, 1999.

BACKGROUND OF THE INVENTION

1. Field of the Invention

The present invention relates to insulated beverage containers. Specifically, the invention relates to an insulated beverage cooler having an insulated, mating, hinged lid.

2. Description of Related Art

The desirability of consuming a can of beer or soda in a chilled state, regardless of the temperature of the environment in which these beverages are consumed, has prompted the development of apparatus to insulate these chilled beverages during consumption. One such device of contemporary popularity is a can holder molded into an insulative cup configuration suitable for receiving a beverage can. Such insulative cups are most popular outdoors where an uninsulated beverage would quickly absorb the heat of the environment.

Several such devices used for chilling beverage cans include: U.S. Pat. No. 4,620,426 issued to Pitchford et al.; U.S. Pat. No. 5,564,583 issued to Kelley et al.; and U.S. Pat. No. 4,741,176 issued to Johnson et al. The problem with each of these inventions is that they contain a multitude of parts, require some preparation before use and generally introduce inconveniences in dispensing and closing, particularly if the user of these devices is using them while simultaneously engaging in sports, handiwork, or other activities requiring one free hand, or to repeatedly set down and pick up the beverage without fear of spilling the contents.

Other inventions employ refrigerants, multiple layers or dead air space surrounding the beverage can to keep the can insulated. Among those are: U.S. Pat. No. 4,183,226 issued to Moore; U.S. Pat. No. 3,995,445 issued to Huskins; U.S. Pat. No. 5,361,604 issued to Pier et al; and U.S. Pat. No. 4,793,149 issued to Riche. One main problem with each of these receptacles is that the insulating structures require more space and are thus more difficult to hold. In addition, with each of these devices, the top of the receptacle is left open and thus the contents of the beverage within the receptacle are subject to warming, invasion by insects and air-borne debris, and spilling if the receptacle is tipped over. Finally, some of the refrigerating devices require preparation or refrigeration prior to use and are thus inconvenient.

U.S. Pat. No. 4,344,303, issued to Kelly, Jr., is a foam receptacle that may serve its intended purpose, but it is not spill resistant and again, there is no lid. The problem with the above devices is that the top surface becomes a vehicle for heat transfer. Also, without having a lid, the receptacle is not capable of preventing intrusion by insects and airborne debris that may be encountered in many different environments, for example when using an electric saw.

British Pat. No. GB 2240332, issued to Christopher Rudland, includes a receptacle for a carbonated beverage with a lid. However, the Rudland device has multiple parts, is pressurized, and has a screw-on lid making it inconvenient for rapid, previously described uses, or one-handed operation.

None of the above inventions and patents, taken either singly or in combination, is seen to describe the instant invention as claimed.

SUMMARY OF THE INVENTION

The present invention is an insulating receptacle for a beverage can that is light weight, compact, simple in construction, insulates the entire can surface from heat exchange, and protects an open can from air-borne debris, bees, black flies, and other insects. The receptacle lid also prevents accidental spillage of the contents of the can. The lid can be operated, i.e. opened and closed, by the thumb of a single hand. A resilient hinge assembled through two collinear slots, one in the main body and one in the lid, maintains a connection between the lid and main body of the receptacle, and tethers the lid to the main body when the lid is in its opened position.

Accordingly, it is a principal object of the invention to provide a simple, light-weight, easy to use can cooler for a single can.

Another object of the invention is to provide a can cooler receptacle that is form fitted so as to be snug against a can.

Still another object of the invention is to provide a can cooler receptacle having a sloped upper surface to facilitate easy insertion of a can.

It is a further object of the invention to provide a can cooler receptacle with an insulating lid that can quickly mate with the body of the receptacle without any twisting or turning of the lid, and can be operated with a single hand.

It is yet a further object of the invention to provide a can cooler having an insulating lid that is snug against the surface of the can, and that is flush with the main body of the receptacle.

It is a further object of the invention to provide a two-part can cooler consisting of a body connected to a flexible, light weight hinge that requires no fasteners on the lid or body.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
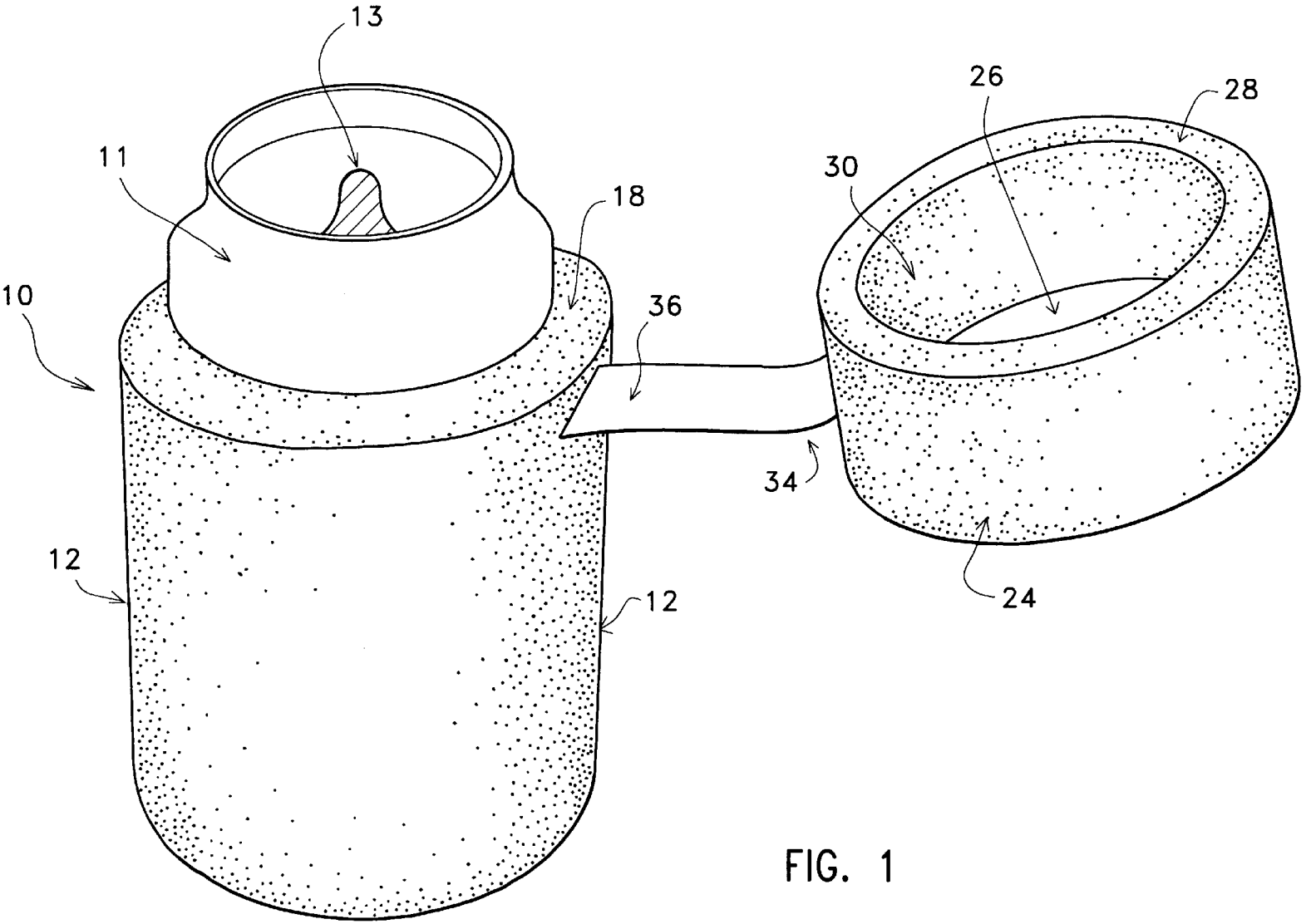
FIG. 1 is an environmental, perspective view of a can cooler according to the present invention.

The present invention is a can cooler 10 shown about a can 11 in FIG. 1, consisting of a cylindrical foam main body portion 12 having a longitudinal axis that is vertically oriented. Portion 12 has an integral foam base 14 at the bottom end of body portion 12. Foam base 14 has a small hole 16 in its center to conduct vapors or drips from inside the can cooler 10 to an external surface, or to the ground. Body portion 12 has a lid-receiving open end 18 opposite base 14, and a solid body portion wall 20 connecting base 14 to open end 18. Body portion wall 20 has formed therein a horizontally oriented first slot 22 passing through wall 20.

The can cooler has a cylindrical foam lid portion 24 wherein lid portion 24 has a vertical longitudinal axis collinear with the longitudinal axis of body portion 12. Lid portion 24 has an integral foam top end 26 parallel to base 14, and an open end 28 opposite top end 26. A solid lid portion wall 30 connects top end 26 to open end 28. Lid portion wall 30 has formed therein a horizontal second slot 32 parallel to and directly above first slot 22. Lid portion wall 30 has the same thickness and is flush with body portion wall 20.

Figure 2:
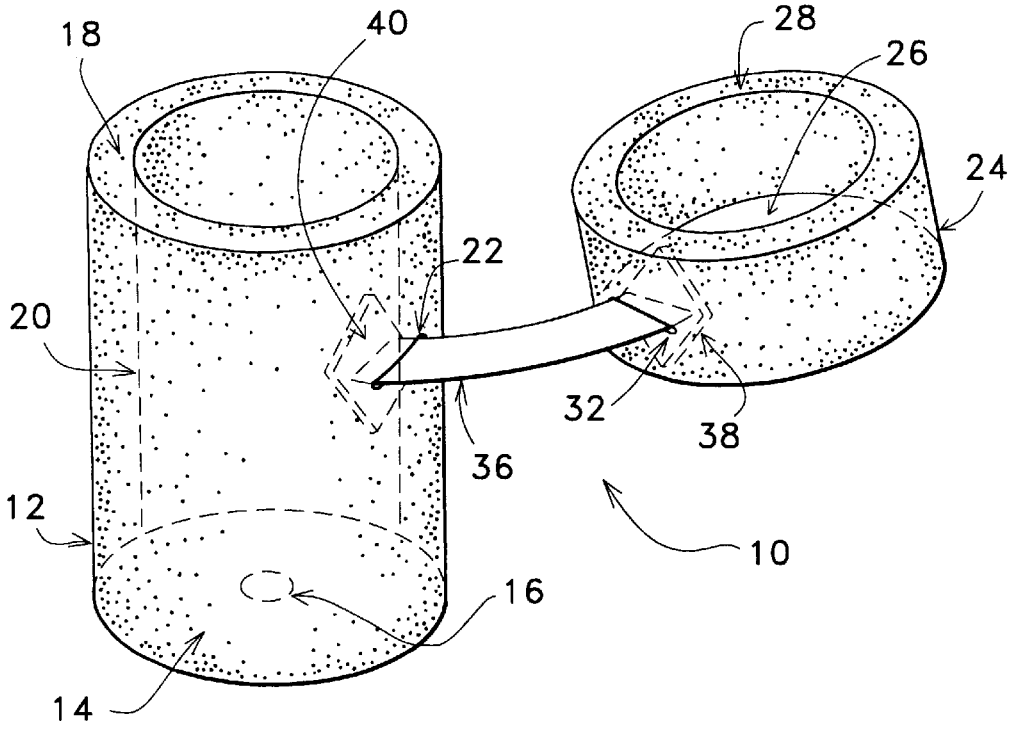
FIG. 2 is a perspective view of the main body and lid of the can cooler showing the disposition of the hinge.
Figure 4C:
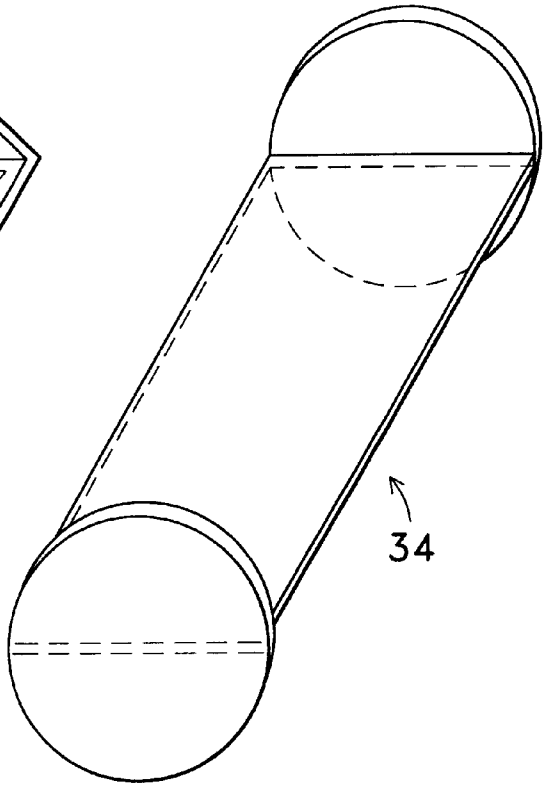
FIGS. 4(A–C) are three different embodiments for the ends of the lid hinge.
Figure 4B:
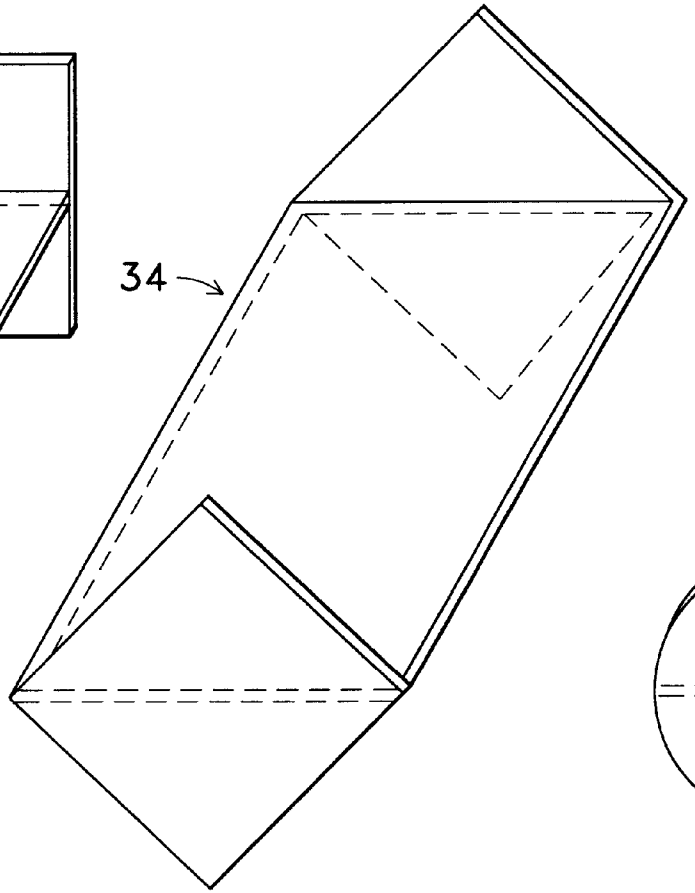
Figure 4A:
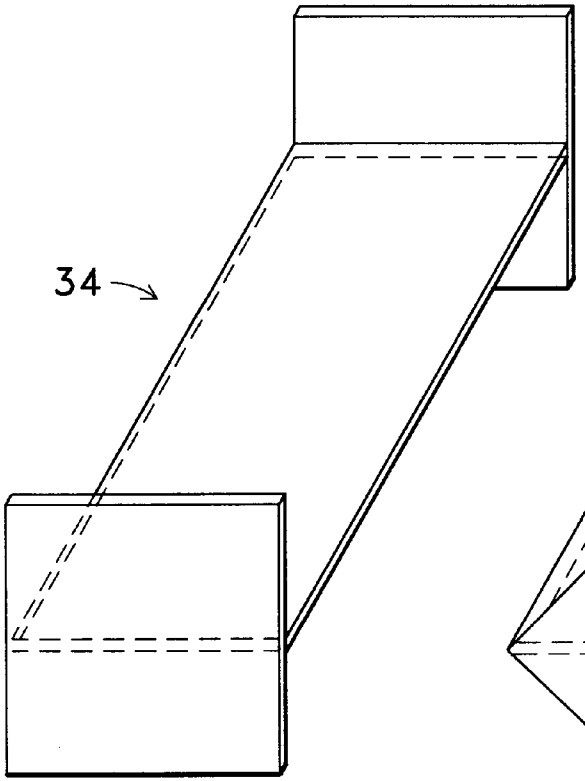

An elastic, preferably plastic, one-piece hinge 34 shown in FIG. 2 connects lid portion 24 to body portion 12 and is constructed of a flattened shaft 36 (or flexible strap) connecting two flat head segments 38, 40. Shaft 36 has a sufficient length such that there is some slack in shaft 36 when lid portion 24 is closed against body portion 12. Head segments 38, 40 are substantially flat and planar, and have major surfaces disposed normal to the plane formed by the major surface of shaft 36. Segments 38 and 40 are located at opposite ends of shaft 36. One of each of head segments 38, 40 is capable of being deformed relative to shaft 36 so as to enter through first slot 22 and bear against an inner surface of body portion wall 20. By "capable of being deformed relative to shaft 36", it is meant that the heads 38 and 40 are hingedly or resiliently attached to the ends of the shaft 36 so that the heads 38 and 40 may be bent to a position substantially parallel to the shaft 36 for insertion through the slots 22 and 32, and after insertion through the slots 22 and 32, the heads 38 and 40 resume their relaxed orientation normal to the shaft 36 in order to retain the shaft 36 in connection with the body portion 12 and the lid portion 24, respectively. The other of head segments 38, 40 can be similarly deformed so as to enter through second slot 32 and bear against an inner surface of lid portion wall 30. Three embodiments of the hinge are shown in FIGS. 4A–4C, corresponding to hinges having three different head segments (square, diamond, and circular, respectively), each of which works equally well in any embodiment of the invention.

Figure 3A:
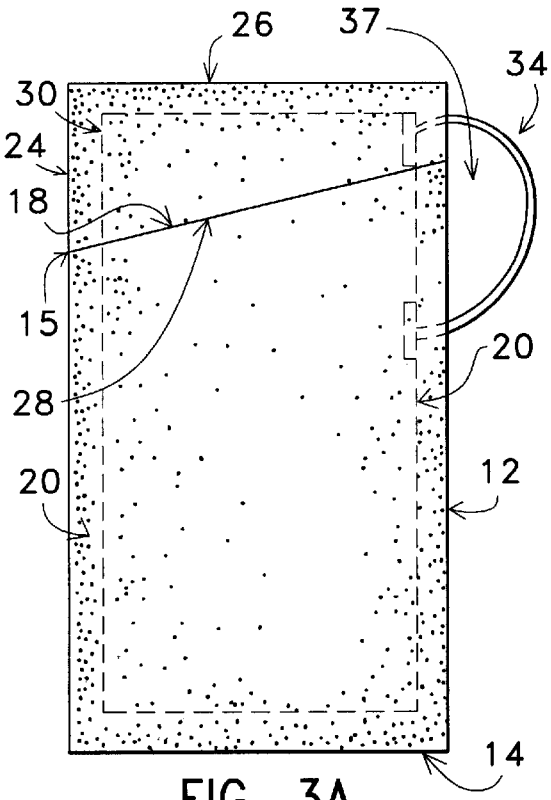
FIG. 3A is a side view of the preferred embodiment showing a sloping fit between the main body and the lid of the can cooler.

A side view of the preferred can cooler embodiment is shown in FIG. 3A. According to FIG. 3A, open end 18 of main body portion 12 is slanted relative to a plane normal to the longitudinal axis of the main body portion 12. Due to the slant, open end 18 has an upper end and a lower end whereby the upper end is closer to the hinge shaft 36, and the lower end is on the opposite side, away from shaft 36. Open end 28 of lid portion 24 is complementarily slanted such that lid portion 24 and body portion 12 can be mated to form a foam can cooler 10 cylinder having two parallel horizontal closed ends, 14, 26.

Figure 3B:
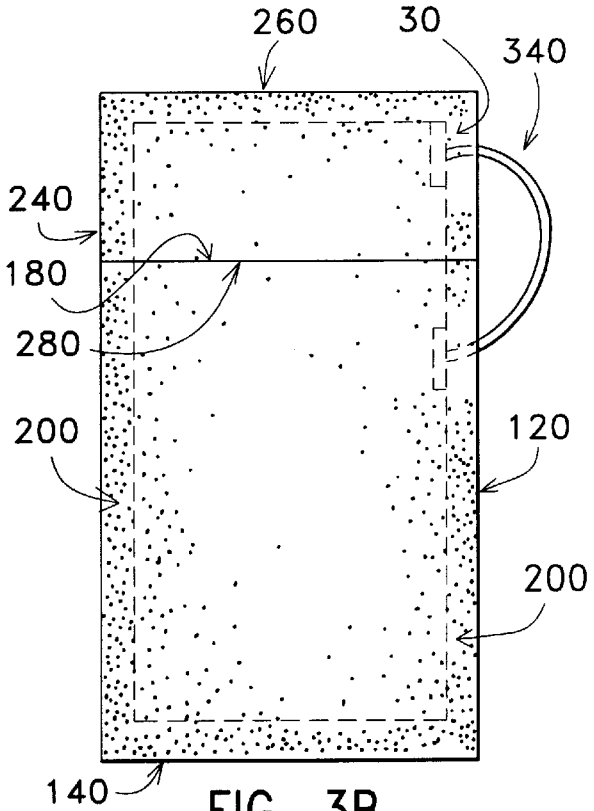
FIG. 3B is a side view of an alternate embodiment showing a plane between the lid and main body that is normal to the longitudinal axis of the can cooler.

FIG. 3B shows a side view of an alternate embodiment of the can cooler where the lid-receiving end 180 of body portion 120 is disposed on a horizontal plane normal to the longitudinal axis of body portion 120. Open end 280 of lid portion 240 is on a horizontal plane normal to the longitudinal axis such that lid portion 240 and body portion 120 can be mated to form a foam can cooler 100 cylinder having two parallel horizontal closed ends, 140, 260.

The preferred method of operating the preferred can cooler comprises the steps of inserting a can 11 into body portion 12 of the can cooler 10 such that a dispensing opening 13 on can 11 is proximate to a lower end of the slanted open end 18 of body portion 12. The slant on body portion 12 is advantageous because, due to the slanted open end 18, a smaller surface area on the bottom of the can 11 contacts the slanted body portion as the can 11 commences its slide into body portion 12 and thus there is less entry friction against the can 11. Moreover, due to the slant of the receptacle, the can 11 may be angled slightly to better and more quickly ensure its receipt into body portion 12. In addition, a complementing slant on lid portion 24 means that lid portion 24 can be more easily forced over an upper end of the can 11 by one hand. When holding the closed can cooler 10, it is best to place the can cooler 10 in a hand such that the thumb of that hand is proximate to the lower end of open end 18 whereas the index finger of the hand slides through an opening 37 defined by the hinge shaft 36 and the outer surface of the can cooler when lid 24 is in the closed position.

To open lid 24 of the can cooler, one may simply insert the thumb between a lower edge of open end 28 of lid portion 24 and the lower end of open end 18 of body portion 12. Next, one raises the thumb vertically against the lower edge of lid portion 24 while pressing the index finger downward against the slack in hinge shaft 36.

The main body portion 12 and lid portion 24 of the can cooler 10 may be made from any thermoplastic material capable of thermally insulating the beverage can. Such materials are well known in the art, and may include, by way of example and not for purposes of limitation, polystyrene or polyurethane foam.

It is to be understood that the present invention is not limited to the sole embodiments described above, but encompasses any and all embodiments within the scope of the following claims.

I claim:

1. A can cooler comprising:

an elongated main body portion having a closed bottom end, an open top end and a first cylindrical side wall having a first thickness, said main body portion including a first horizontal slot formed in the first cylindrical side wall proximate the open end;

a lid portion having a closed top end, an open bottom end matable with the open end of said main body portion, and a second cylindrical side wall having a second thickness, said lid portion including a second horizontal slot formed in the second cylindrical side wall proximate the open bottom end, wherein the second thickness of said second cylindrical wall is equal to the first thickness of said first cylindrical side wall;

said main body portion and said lid portion being made of a foamed insulating material; and a one-piece hinge tethering said lid portion to said main body portion, said hinge consisting of a flexible plastic strap having a first end and second end, the first end extending through the first slot of said main body portion and having a first flat head member traversely attached thereto, and the second end extending through the second slot of said lid portion and having a second flat head member traversely attached thereto.

2. The device according to claim 1, wherein the open top end of said main body portion is slanted downward at an angle relative to the first slot and the open bottom end of said lid portion is slanted downward at a complementary angle relative to said second slot.

3. The can cooler according to claim 1, wherein the open top end of said main body portion is disposed in a plane normal to a first longitudinal axis extending through said main body portion and the open end of said lid portion is in a plane normal to a second longitudinal axis extending through said lid portion.

4. The can cooler according to claim 1, wherein said main body portion and said lid portion are made from polystyrene.

5. The can cooler according to claim 1, wherein said main body portion and said lid portion are made from polyurethane.

6. The can cooler according to claim 1, wherein said main body portion is sized and dimensioned to enclose a substantial portion of a beverage can, and when the lid portion is placed over the can in abutting contact with said main body portion the can is completely enclosed.

7. The can cooler according to claim 1, wherein the closed bottom end of said main body portion includes a centered drain hole.

* * * * *